US005326049A

United States Patent [19]

Rom et al.

[11] Patent Number: 5,326,049

[45] Date of Patent: Jul. 5, 1994

[54] DEVICE INCLUDING A BODY HAVING FOLDED APPENDAGE TO BE DEPLOYED UPON ACCELERATION

[75] Inventors: Hanan Rom, Misgav; Oded Yehezkeli, Kiryat Haim, both of Israel

[73] Assignee: State of Israel - Ministry of Defense Rafael-Armament Development Authority, Haifa, Israel

[21] Appl. No.: 3,045

[22] Filed: Jan. 11, 1993

[30] Foreign Application Priority Data

Apr. 30, 1992 [IL] Israel ..... 101730

[51] Int. Cl.[5] ..... F42B 10/14

[52] U.S. Cl. ..... 244/3.280; 102/388; 244/49; 244/173; 343/882; 343/DIG. 2

[58] Field of Search ..... 244/3.27-3.29, 244/3.24, 3.25, 3.3, 49, 173; 343/882, 915, DIG. 2; 102/388

[56] References Cited

U.S. PATENT DOCUMENTS

| | | | |
|---|---|---|---|
| 3,063,375 | 11/1962 | Hawley et al. | 244/3.27 |
| 3,588,004 | 6/1971 | Suter . | |
| 3,598,345 | 8/1971 | Suter . | |
| 3,602,459 | 8/1971 | Pesarini et al. | 244/3.27 |
| 3,627,233 | 12/1971 | Jacobson et al. . | |
| 3,684,215 | 8/1972 | Jacobson et al. | 244/3.27 |
| 3,918,664 | 11/1975 | Grosswendt . | |
| 4,336,914 | 6/1982 | Thomson | 244/3.27 |
| 4,588,146 | 5/1986 | Schaeffel, Jr. et al. . | |
| 4,667,899 | 5/1987 | Wedertz . | |
| 4,717,093 | 1/1988 | Rosenberger . | |
| 5,108,051 | 4/1992 | Montet et al. | 244/3.28 |

FOREIGN PATENT DOCUMENTS

| | | |
|---|---|---|
| 0318359 | 5/1989 | European Pat. Off. . |
| 1187035 | 4/1970 | United Kingdom . |

*Primary Examiner*—Harold J. Tudor
*Attorney, Agent, or Firm*—Mark M. Friedman

[57] ABSTRACT

A device, particularly a missile, includes a body having an appendage, e.g., a wing, normally folded in an inoperative position and to be unfolded to an operative position when the body is accelerated in the direction of the longitudinal axis of the body. The appendage is pivotally mounted about a first pivot axis extending perpendicularly to the longitudinal axis of the body, and also about a second pivot axis extending parallel to the longitudinal axis of the body. The center of gravity of the appendage is outwardly of the first pivot axis in the folded condition of the appendage such that the acceleration of the body produces a moment pivotting the appendage about the first pivot axis.

17 Claims, 3 Drawing Sheets

DEVICE INCLUDING A BODY HAVING FOLDED APPENDAGE TO BE DEPLOYED UPON ACCELERATION

FIELD AND BACKGROUND OF THE INVENTION

The present invention relates to a device including a body having a folded appendage which is to be deployed upon acceleration of the body. The invention is particularly useful with respect to missiles or other forms of aircraft or seacraft having one or more wings, fins, vanes or the like, which are normally folded on the body but which are to be unfolded to a deployed condition upon acceleration of the body. The invention is therefore described below with respect to such an application, but it will be appreciated that the invention could also advantageously be used in other applications as well, e.g., for deploying antenna systems, solar collector panels, etc., in spacecraft.

Missiles are conventionally housed in canisters and frequently include foldable wings which are folded in order to accommodate the missile within the canister. In the conventional foldable wing construction, the wing is pivotally mounted from a folded, non-operative, position while the missile is in the canister, to an extended or operative position after the missile leaves the canister. Such a construction permits the use of wings having relatively large wing spans to be accommodated in relatively small canisters.

OBJECTS AND BRIEF SUMMARY OF THE INVENTION

An object of the present invention is to provide a device including a body with a novel mounting for a foldable appendage to be unfolded or deployed upon the acceleration of the body in the direction of its longitudinal axis. A more particular object of the invention is to provide a canister-launched missile with a foldable wing construction which permits the use of wings having substantially larger wing spans to be used with relatively small canisters.

According to one aspect of the present invention, there is provided a device including a body having an appendage normally folded in an inoperative position on the body and to be unfolded to an operative position when the body is accelerated in the direction of the longitudinal axis of the body; the device including a socket member fixed to the body so as to project outwardly of its outer surface; and a hinge member pivotally mounted at one end to the socket member about a first pivot axis extending outwardly of the outer surface of the body and perpendicular to the longitudinal axis of the body. The opposite end of the hinge member pivotally mounts the appendage about a second pivot axis extending further outwardly of the outer surface of the body and parallel to the longitudinal axis of the body. The socket member includes a contact surface outwardly of the outer surface of the body engageable by the appendage in its normal folded position to locate the center of gravity of the appendage outwardly of the first pivot axis and inwardly of the second pivot axis. The arrangement is such that the acceleration of the body produces a moment first pivotting the appendage about the first pivot axis to move the center of gravity of the appendage outwardly of the second pivot axis, and then to move the appendage about both the first and second pivot axes to the operative position of the appendage.

In such a construction, the acceleration (or intertial) forces alone may be sufficient to fully open the appendage. However, according to another feature in the described preferred embodiment, it may desirable to include a spring which is prestressed in the fully folded condition of the appendage to produce an initial moment tending to pivot the appendage about the second pivot axis. In the described embodiment, the spring is a torsion bar.

According to further features in the preferred embodiment of the invention described below, the body is a missile, and the appendage is a wing. In its fully folded condition, the wing occupies a plane which is generally tangential to the outer surface of the missile. The wing is pivotally mounted about the first and second pivot axes to occupy a plane which is substantially radial to the missile.

A missile including foldable wings constructed in accordance with the above features may have a relatively large wing span in the operative condition of the wings, and may still be accommodated in a relatively small canister in the non-operative condition of the wings.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
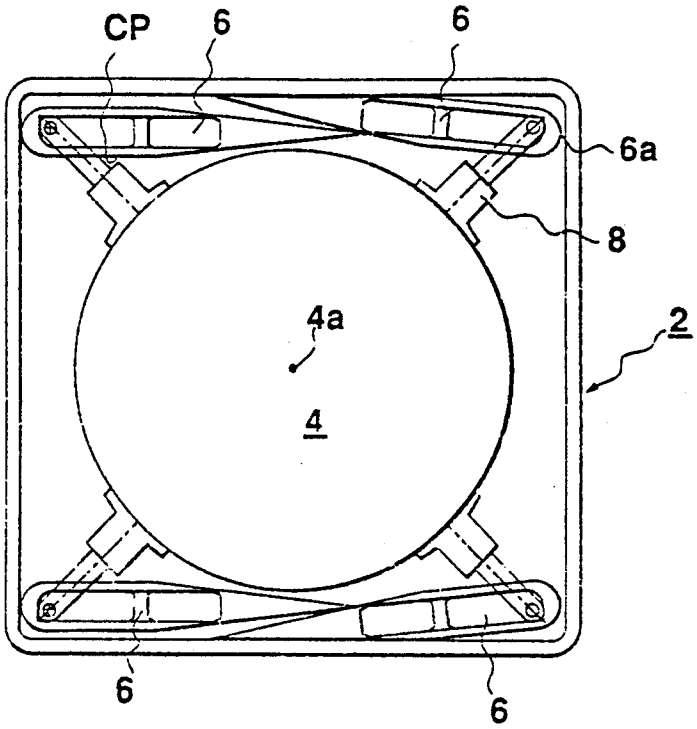
FIG. 1 is a front elevational view illustrating a missile constructed in accordance with the invention and housed within a canister.

With reference first to FIG. 1, there is illustrated a canister, generally designated 2, housing a missile 4 having four foldable wings 6. Each of the four foldable wings is mounted to the missile 4 by a pivotal assembly, generally designated 8. In the fully-folded condition of the wings 6, the wings are folded so as to be very close to or in contact with the outer surface of the missile 4, and thereby to minimize the size of the canister 2 necessary to accommodate the missile with its foldable wings.

Figure 2:
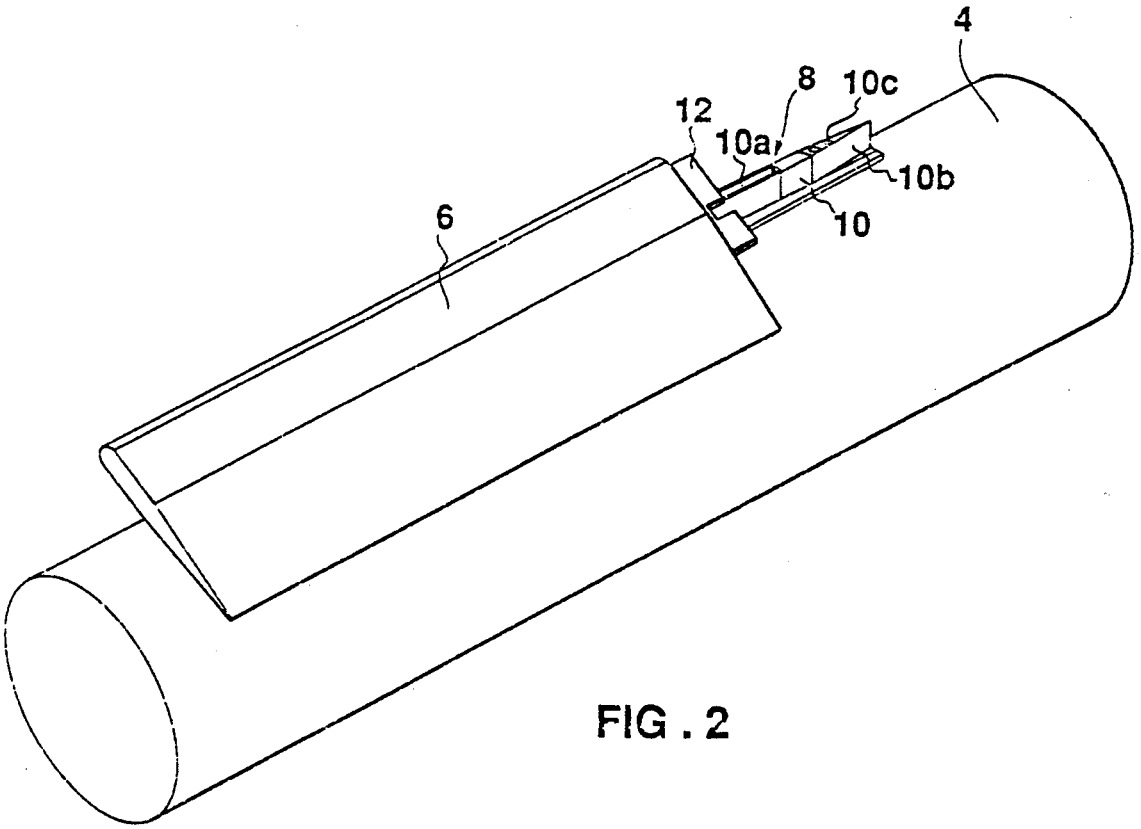
FIG. 2 is a perspective view illustrating one wing of the missile of FIG. 1 in the fully-folded condition of the wing when the missile is in the canister.
Figure 3:
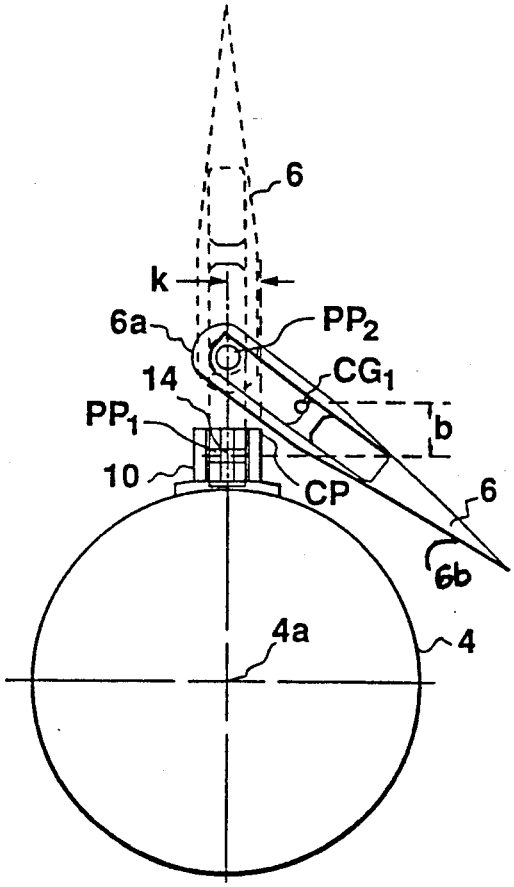
FIG. 3 is a front elevational view illustrating the movement of the wing about one of its pivot axes.

The fully-folded condition of each wing 6 in FIG. 1 is more particularly illustrated in FIGS. 2 and 3. It will be seen from FIG. 3 that the wing, when in its fully-folded condition (shown in full lines), occupies a plane which is generally tangential to the outer surface of the missile, and with one longitudinal edge 6*a* of the wing substantially parallel to the missile longitudinal axis 4*a*. In the fully-open condition of the wing (shown in full lines in FIG. 5), the wing assumes a position which is substantially radial to the missile.

The mounting assembly 8 for each of the four foldable wings 6 is located at the rear corner of the respective wing overlying the longitudinal axis 4a of the missile. Each assembly 8 includes a socket member 10 fixed to the missile parallel to its longitudinal axis, a stem 12 fixed to one end of the wing 6, and a hinge member 14. A pivot pin $PP_1$, defining a first pivot axis, extends perpendicularly to the missile longitudinal axis 4a and passes through the inner end of hinge member 14 and socket member 10. A second pivot pin $PP_2$, defining a second pivot axis, extends parallel to the missile longitudinal axis 4a and passes through the outer end of hinge member 14 and the stem 12.

Figure 4:
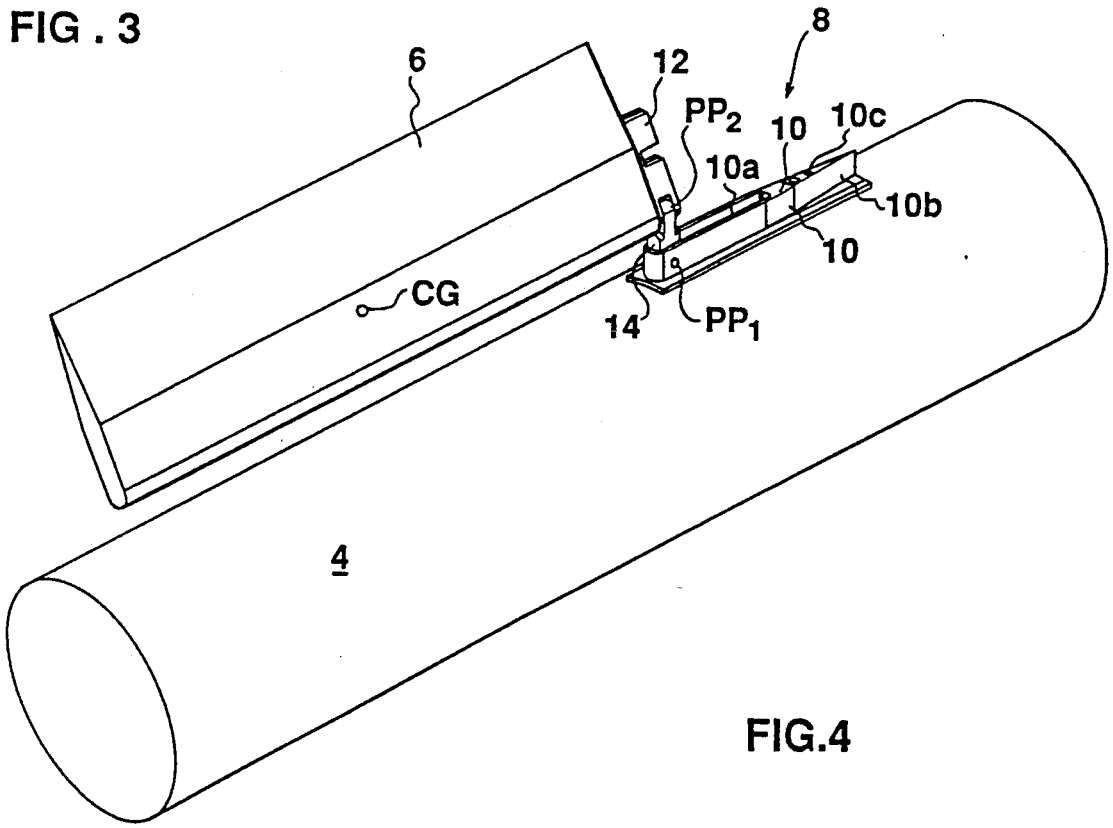
FIG. 4 is a perspective view illustrating the missile wing in its position (theoretical) after having moved about the pivot axis of FIG. 3)
Figure 5:
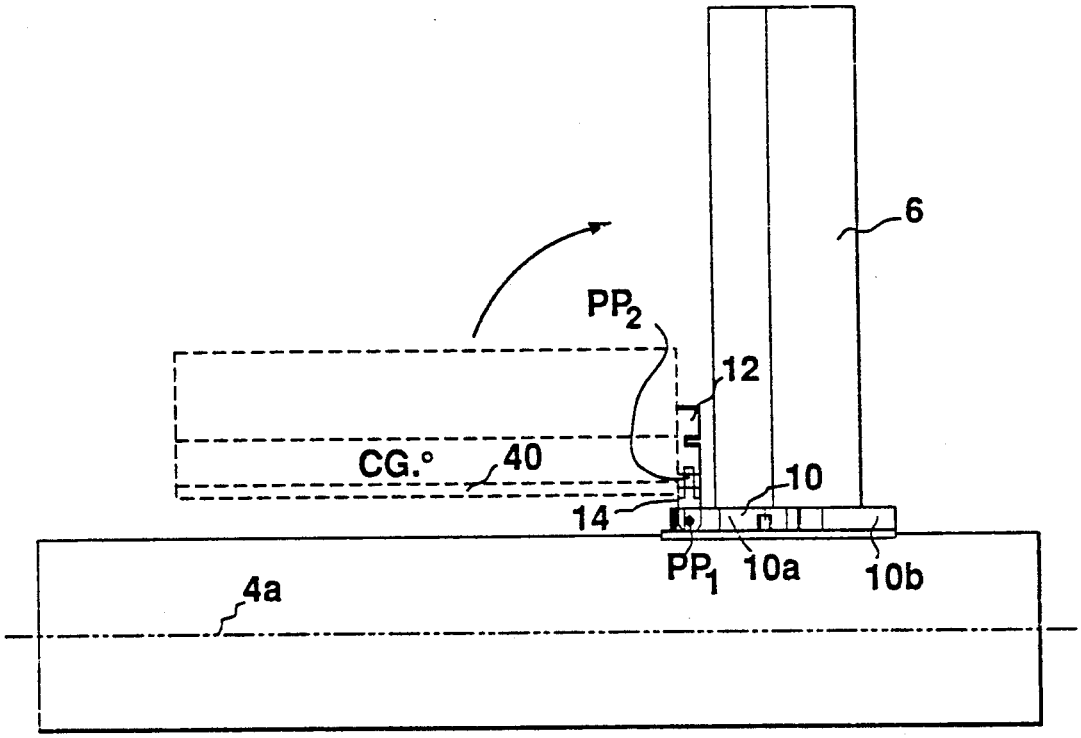
FIG. 5 is a side elevational view illustrating the movement of the wing about the other of its pivot axes.

Socket member 10 includes a forward section formed with a socket 10a configured to receive the stem 12 in the fully extended, or operative, position of the wing 6 as shown in full lines in FIG. 5. Socket member 10 is further formed with a rear section 10b which is aerodynamically shaped, decreasing in width towards it rear tip, and conforms to the dynamically-shaped rear section 6b of the wing 6. The socket member 10 may be fixed to the missile in any suitable member, as by fasteners 10c (FIG. 4) passing through the rear section of the socket member.

Figure 6:
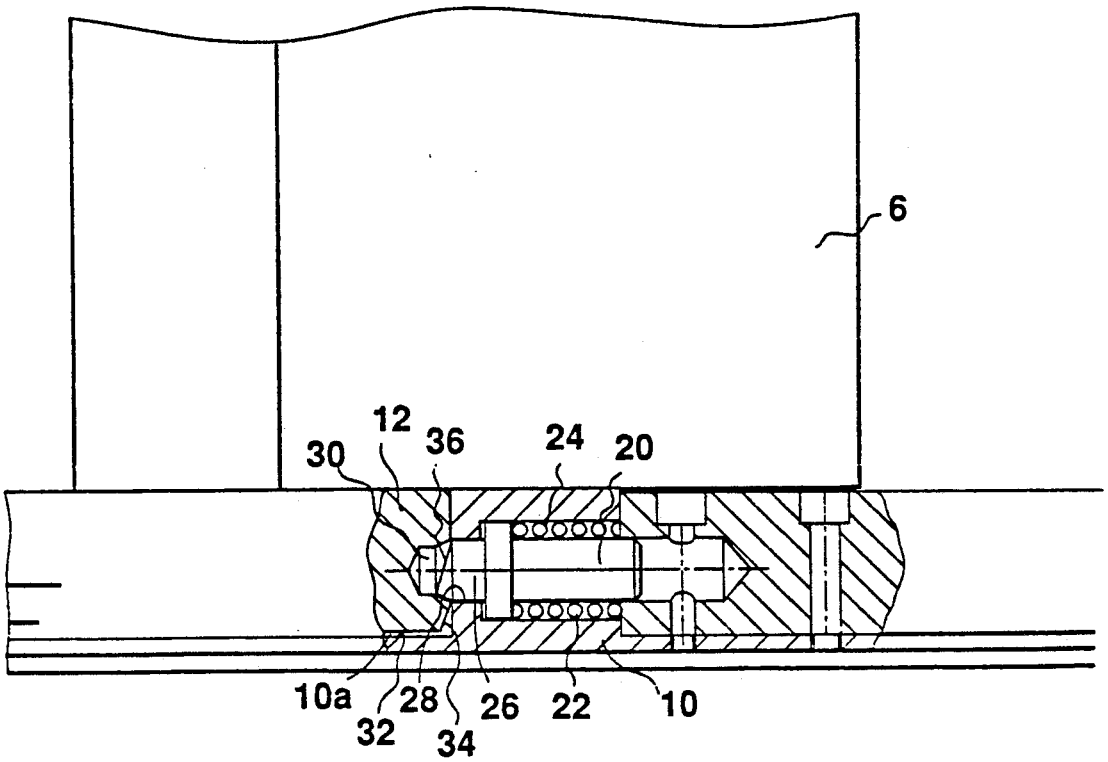
FIG. 6 is a sectional view illustrating an example of the locking mechanism for locking the wing in its fully-open, operative condition.

Socket member 10 further includes a locking device which locks the wing 6 when in its fully-open, operative condition, as illustrated in full lines in FIG. 5 and particularly in FIG. 6. Thus, as shown in the latter figure, the locking device includes a plunger 20 received within a cavity 22 formed in socket member 10 and normally urged, by spring 24, to project the head 26 of the plunger 20 through a bore 28 formed in the socket member. Stem 12 is formed with a recess 30 spaced from the bottom edge 32 of the stem when the stem is received within the socket 10a of socket member 10.

The edge 34 of stem 12, between its recess 30 and its lower edge 32, is tapered, as shown at 34; and the outer face of plunger 26 projecting in recess 30 is correspondingly tapered, as shown at 36. The two tapered surfaces 34 and 36 define camming surfaces which automatically, upon the stem 12 entering socket 10a, cam the plunger 20 in one direction (rightwardly, FIG. 6) against spring 24, to permit the full entry of the stem into the socket. As soon as the stem has completely entered the socket, spring 24 snaps plunger 20 in the opposite direction (leftwardly, FIG. 6) to move the outer portion of its head 26 into recess 30 of the stem, thereby firmly locking the stem in the socket 10a.

As will be described more particularly below, the wing 6 may be pivoted from its fully-folded position to its fully-open position only by inertial, i.e., acceleration, forces. However, a spring may be included to initiate and/or to enhance this movement of the wing. In this case, such a spring is provided in the form of a torsion bar 40 extending along the lower thickened edge 6a of the wing. Torsion bar 40 is prestressed in torsion in the fully-folded condition of the wing as shown in FIGS. 1 and 2, so that as soon as the missile leaves the canister 2, the prestressed torsion bar 40 initiates or augments the pivoting of the wing 6 about pivot axis $PP_2$ towards the partially-open (theoretical) condition illustrated in FIGS. 3 and 4.

The illustrated arrangement operates in the following manner:

When the missile 4 is in the canister 2, its four wings 6 are in their fully-folded condition as illustrated in FIGS. 1 and 2. In this fully-folded condition, each wing occupies a plane which is generally tangential to the outer surface of the missile 4; also the wing longitudinal edge 6a, coupled to the missile by means of the pivotal assembly 8, is substantially parallel to the missile longitudinal axis 4a, as best seen in FIG. 3.

As also seen in FIG. 3, in this fully-folded condition of the wings, the inner surface of each wing contacts the outer corner of the socket member 10 at a contact point CP which is located laterally of the pivot axis $PP_2$ by the distance "k". Contact point CP is thus engageable by the wing in its normal folded position to locate the center of gravity CG of the wing outwardly of the first pivot axis $PP_1$ and inwardly of the second pivot axis $PP_2$. The location of the center of gravity CG of the wing outwardly of the pivot axis $PP_1$ is at a distance "b".

Accordingly, as soon as the missile 4 leaves the canister and accelerates in the direction of its longitudinal axis 4a, the acceleration of the missile produces an inertial force through the center of gravity CG opposite to the direction of acceleration of the missile. The reaction force produced at the center of gravity CG of the wing, multiplied by the distance "b", produces a moment pivoting the wing 6 about pivot axis $PP_1$. This pivoting of the wing about pivot axis $PP_1$ moves the wing center of gravity CG outwardly of the pivot axis $PP_2$, so that the inertial force at the center of gravity CG of the wing now produces a moment tending to pivot the wing about pivot axis $PP_2$. Thus, as soon as the missile leaves the canister, the wing 6 tends to pivot about both pivot axes $PP_1$ and $PP_2$.

The described embodiment includes the prestressed torsion bar 40. This torsion bar also applies a force producing a moment tending to pivot the wing about pivot axis $PP_2$.

It will thus be seen that the wing 6 is pivoted about both the pivot axis $PP_1$ and $PP_2$ as soon as the missile leaves the canister. As the wing moves about pivot axis $PP_1$, its stem 12 (FIG. 4) approaches the socket member 10a fixed to the missile. As soon as the stem 12 begins to enter the socket member 10a, its cam surface 34 (FIG. 6) engages cam surface 36 of the locking plunger 20, to first retract the plunger within its cavity 22, and then to permit the spring 24 to snap the plunger head 26 into recess 30 of the stem, and thereby to firmly lock the wing 6 in its fully-extended position.

It will be appreciated that the movement of wing 6 about both pivot axes increases the moment applied to the wing and thereby accelerates its pivotal movements.

While the invention has been described with respect to one preferred embodiment, it will be appreciated that this is set forth merely for purposes of example, and that many variations may be made. For example, the torsion spring 40 could be omitted so long as the center of gravity CG of the wing 6 is outwardly of the first pivot axis $PP_1$. In addition, the invention may be used in other applications, for example in deploying antenna assembles, solar panels, or the like in spacecraft, or deploying fins in torpedoes. Many other variations, modifications and applications of the invention will be apparent.

What is claimed is:

1. A device including a body having an appendage normally folded in an inoperative position on the body and to be unfolded to an operative position when the body is accelerated in the direction of the longitudinal axis of the body; said device including:

a socket member fixed to said body so as to project outwardly of its outer surface;

a hinge member pivotally mounted at one end to said socket member about a first pivot axis extending outwardly of the outer surface of said body and perpendicular to the longitudinal axis of said body;

the opposite end of said hinge member pivotally mounting said appendage about a second pivot axis extending further outwardly of the outer surface of said body and parallel to the longitudinal axis of said body;

said socket member including a contact surface outwardly of the outer surface of said body engageable by said appendage in its normal folded position to locate the center of gravity of the appendage outwardly of the first pivot axis and inwardly of said second pivot axis, such that the acceleration of the body produces a moment first pivotting the appendage about said first pivot axis to move the center of gravity of the appendage outwardly of said second pivot axis, and then to move the appendage about both said first and second pivot axes to the operative position of the appendage.

2. The device according to claim 1, wherein said appendage includes a spring which is prestressed in the fully folded condition of the appendage to produce an initial moment tending to pivot the appendage about said second pivot axis.

3. The device according to claim 2, wherein said spring is a torsion bar.

4. The device according to claim 1, wherein said body is a missile, and said appendage is a wing which, in its folded condition, occupies a plane which is generally tangential to the outer surface of the missile; said wing being pivotally mounted about said first and second pivot axes to occupy a plane which is substantially radial to the missile.

5. The missile according to claim 4, further including: a stem fixed to a pivotally mounted end of the wing; and a locking device located within said socket member for engaging and locking said stem when received in the socket member after the wing has pivoted about said first and second pivotal axes.

6. The missile according to claim 5, wherein said first pivot axis is constituted of a first pivot pin between said socket member fixed to the missile and one end of the hinge member, and said second pivot axis is constituted of a second pivot pin between the opposite end of said hinge member and said stem.

7. The missile according to claim 5, wherein said locking device includes a plunger and a spring urging said plunger to a locking position with respect to said stem; said plunger and stem being formed with cooperable camming surfaces which automatically, upon the stem being moved initially into said socket, to cam the plunger in one direction against said spring and thereby to permit full entry of the stem into the socket, and then to permit the spring to move the plunger in the opposite direction to lock the stem in said socket.

8. The missile according to claim 7, wherein said stem is formed with a recess for receiving said plunger; said recess being spaced from the lower end of the stem; the edge of the stem between said recess and lower end being formed with said camming surface.

9. A missile including a wing normally folded in an inoperative position on the missile and to be unfolded to an operative position when the missile is accelerated in the direction of the longitudinal axis of the missile;

a socket member fixed to said missile so as to project outwardly of its outer surface;

a hinge member pivotally mounted at one end to said socket member about a first pivot axis extending outwardly of the outer surface of said missile and perpendicular to the longitudinal axis of said missile;

the opposite end of said hinge member pivotally mounting said wing about a second pivot axis extending further outwardly of the outer surface of said missile and parallel to the longitudinal axis of said missile;

said socket member including a contact surface outwardly of the outer surface of the missile engageable by said wing in its normal folded position to locate the center of gravity of the wing outwardly of the first pivot axis and inwardly of said second pivot axis, such that the acceleration of the missile produces a moment first pivotting the wing about said first pivot axis to move the center of gravity of the wing outwardly of said second pivot axis, and then to move the wing about both said first and second pivot axes to the operative position of the wing.

10. The missile according to claim 9, wherein said wing includes a spring which is prestressed in the fully folded condition of the wing to produce an initial moment tending to pivot the wing about said second pivot axis.

11. The missile according to claim 10, wherein said spring is a torsion bar.

12. The missile according to claim 9, further including: a stem fixed to the pivotally mounted end of the wing; and a locking device located within said socket member for engaging and locking said stem when received in the socket member after the wing has pivoted about said first and second pivotal axes.

13. The missile according to claim 12, wherein said first pivot axis is constituted of a first pivot pin between said socket member fixed to the missile and one end of the hinge member, and said second pivot axis is constituted of a second pivot pin between the opposite end of said hinge member and said stem.

14. The missile according to claim 12, wherein said locking device includes a plunger and a spring urging said plunger to a locking position with respect to said stem; said plunger and stem being formed with cooperable camming surfaces which automatically, upon the stem being moved initially into said socket, to cam the plunger in one direction against said spring and thereby to permit full entry of the stem into the socket, and then to permit the spring to move the plunger in the opposite direction to lock the stem in said socket.

15. The missile according to claim 14, wherein said stem is formed with a recess for receiving said plunger; said recess being spaced from the lower end of the stem; the edge of the stem between said recess and lower end being formed with said camming surface.

16. The missile according to claim 9, and a canister overlying said foldable wing.

17. The missile according to claim 16, wherein said missile includes four of said foldable wings.

* * * * *